United States Patent [19]

Briggs

[11] Patent Number: 5,016,404

[45] Date of Patent: May 21, 1991

[54] GUTTER AND BRACKET ASSEMBLY

[76] Inventor: Jeffrey M. Briggs, 48 Hemlock Dr., Newton, N.J. 07860

[21] Appl. No.: 496,911

[22] Filed: Mar. 21, 1990

[51] Int. Cl.[5] ..... E04D 13/06

[52] U.S. Cl. ..... 52/12; 248/48.1; 248/48.2; 405/119; 52/11

[58] Field of Search ..... 405/118; 52/11, 12, 52/16; 210/474; 248/48.1, 48.2

[56] References Cited

U.S. PATENT DOCUMENTS

| | | | |
|---|---|---|---|
| 288,307 | 11/1883 | Campbell | 248/48.2 |
| 538,108 | 4/1895 | Freeze | 52/11 |
| 603,611 | 5/1898 | Nye . | |
| 891,405 | 6/1908 | Cassens . | |
| 1,003,258 | 9/1911 | Harris | 248/48.1 |
| 1,414,345 | 5/1922 | Eeftink | 248/48.2 |
| 1,855,241 | 4/1932 | Irwin | 248/48.2 |
| 2,024,348 | 12/1935 | Feltman | 248/48.2 |
| 2,761,642 | 9/1956 | Rachlin . | |
| 2,895,694 | 7/1959 | Graving et al. . | |
| 3,053,491 | 9/1962 | Ramser . | |
| 3,296,749 | 1/1967 | Cotter . | |
| 3,388,555 | 6/1968 | Foster . | |
| 3,855,132 | 12/1974 | Dugan | 210/474 X |
| 4,195,452 | 4/1980 | Smith et al. | 52/11 |
| 4,199,121 | 4/1980 | Le Febvre . | |
| 4,311,292 | 1/1982 | Deason . | |
| 4,404,775 | 9/1983 | Demartini | 405/119 X |
| 4,493,588 | 1/1985 | Duffy . | |
| 4,497,146 | 2/1985 | Demartini | 52/12 |

FOREIGN PATENT DOCUMENTS 654296 12/1962 Canada .

OTHER PUBLICATIONS

Eliminate Gutter Problems Advanced Systems Brochure Advertisement.

Berger Brothers Co. Brochure, Style K Gutter Systems. Half Round Gutter Systems . . . & Gutter Helmet.

Klauer Manufacturing Co. Brochure Catalog 85B Metal Building Products 1985.

*Primary Examiner*—Dennis L. Taylor

[57] ABSTRACT

A plurality of spaced brackets each has mutually perpendicular first and second legs with a lip upstanding from the end of one of the legs. A third leg extends from the upstanding second leg parallel to the first leg and overhangs the first leg. A bracket mounting flange extends from the end of the third leg for securing the bracket to the face of a fascia board, the first, second and third legs being beneath the soffit region. The lip and legs are so dimensioned and spaced to releaseably secure a standard K-gutter thereto without additional fasteners. The gutter is partially under the soffit. A sheet layer has an edge beneath the shingles and curves around in front of and below the fascia above the gutter mouth forming a relatively small entrance region with the gutter. The apex of the curve extends beyond the gutter so that debris carried by water run off falls to the ground while the run off flows around the layer into the gutter.

19 Claims, 2 Drawing Sheets

GUTTER AND BRACKET ASSEMBLY

This invention relates to rain gutters sometimes referred to as eaves troughs, and more particularly, to gutters of the type which limit collection of debris therein.

Rain gutters are elongated troughs which are attached to a building at the lower edge of a pitched roof to collect and direct water run off to spaced downspouts. A long felt problem with such gutters is that they readily fill with leaves, branches and other debris. This debris clogs the gutters and the downspouts causing the gutters to overflow defeating their function. Another problem occurs in winter wherein the downspouts and gutters tend to clog with ice preventing melting snow on the roof from properly draining. Due to periodic melt and freeze cycles that often occur during successive day and evening hours, the ice in the downspouts and gutters does not melt sufficiently for draining the gutters such that water accumulating in the gutters freezes and ice builds up in the gutters. Also, the area of the roof over the attic tends to warm somewhat causing melting of snow on the roof. As the melt water runs down, when it runs over the soffit area, which is not as warm due to increased exposure to the ambient atmosphere, it tends to refreeze in this area. This ice may build up under the shingles. This is referred to as ice damming. The water that backs up under the roof shingles and freezes causes subsequent melt water to leak under the shingles into the overhanging soffits, and sometimes, into the building interior.

A number of solutions have been offered to the above problems. For example, Nye in U.S. Pat. No. 603,611 discloses a gutter in which the trough is formed from sheet material and suspended below the roof edge in a curled arrangement which has a relatively small trough mouth beneath the curled sheet material. The mouth of the trough is inset from the roof edge so that debris will fall to the ground while run off will follow the sheet curve into the trough. A similar solution is provided by Duffy in U.S. Pat. No. 4,493,588 in which a screen is provided in the trough mouth and includes a bracket for securing the sheet material to the building. Also, the trough lip is hooked so as to be releaseable. Another solution is proposed by Foster in U.S. Pat. No. 3,388,555 providing a self straining eaves trough. Still other solutions include tilt mechanisms to facilitate cleaning the trough of the debris, which cleaning is otherwise a tedious, laborious unpleasant task. The tilt mechanism permits the gutter to be tilted in a manner so that the gutter contents can be dumped or washed therefrom.

A problem exists with the above-proposed solutions which problem is not addressed by these solutions. This problem is the fact that gutters are a unique structure formed from sheet metal on site by roll form tooling. The reason for this arrangement is that gutters are relatively long and if factory assembled, need to be fabricated in easy to handle lengths, for example, 5-10 foot sections. Such sections create numerous seams which eventually leak due to time failure of most sealing compounds. To make such sections longer makes the gutters unwieldy and difficult to handle, especially for long runs of, for example, 30 or more feet. Therefore, there has evolved the so-called "seamless" gutter which is rolled and formed into the desired gutter configuration at the site of installation by the gutter vendor. The roll forming tooling is commercially standard at this time with most vendors forming a gutter known as the "K" gutter. This is a standard cross section shape which is relatively rigid even when roll formed.

The "K" gutter is typically shown in U.S. Pat. Nos. 2,761,642; 2,895,694; 3,053,491 and 3,296,749 by way of example and also in Canadian Patent No. 654,296. This gutter is almost universally used for most gutter installations. The gutter has a squared rear section comprising a flat bottom wall and a perpendicular rear wall. The front wall extends flared upwardly and outwardly from the bottom wall in a somewhat reverse S-shape from an upstanding lip and terminates at an upper lip which extends inwardly toward the trough mouth and having a folded over forward edge over the mouth. This gutter is typically installed with a spike driven through the upper trough side walls into the fascia through a sleeve located between the upper edges of the trough side walls. Because of the wide acceptance of the K gutter there is a great deal of resistance to convert gutter designs to non-standard configurations shown in the above-mentioned patents regardless the fact that such designs improve the clogging problem of debris and ice damming.

A solution to the debris clogging problem and to the problem of utilizing the "K" gutter is offered in a commercially available structure in which a cover element is attached to the roof at the edge of the roof and extends into the K gutter reducing the mouth opening somewhat. The K gutter is a standard installation at the roof deck plane so that the only change is the addition of the cover. It is believed that water build up in the gutter of this arrangement, because the gutter is at the roof line, may eventually freeze beneath the shingles. Further the mouth of the gutter and cover face upwardly and may readily fill and clog with debris.

The present inventor recognizes a long standing need, therefore, in solving the clogging and ice damming problems employing conventional K type gutters. The present inventor recognizes, therefore, a need to employ such K type gutters intact without any redesign of the gutter construction to take advantage of the present wide commercial use of such gutters, and at the same time, resolve the ice damming and clogging problems.

A support bracket for a channel member, for example a K gutter, having a bottom wall and spaced side walls according to the present invention comprises first and second legs having a length extending in a direction generally normal to each other from a junction therebetween, the first leg for supporting the bottom wall. A lip extends upstanding from an end of the first leg distal the junction juxtaposed with and spaced from the second leg a distance for releaseably receiving the channel member therebetween with one side wall adjacent to the lip and the other side wall adjacent to the second leg. The lip has a length shorter than that of the second leg. A third leg extends from the second leg spaced from the first leg an amount to closely receive the member therebetween. The dimensions of the first, second and third legs relative to the lip length and to the channel member walls are such so as to releaseably secure the channel member to the bracket and yet preclude the member from displacing out of the bracket in the region between the lip and third leg in response to water and ice loads on the channel member. Bracket support means are coupled to the second leg for securing the bracket to the building.

In one embodiment the channel mouth faces the soffit and fascia with a portion of the mouth positioned beneath the soffit and a second portion of the mouth extending beyond the fascia on a side thereof opposite the soffit.

According to a feature of the invention a bent sheet member has one edge region adapted to be secured to the roof for receiving water run off and a second opposing edge region adapted to be secured at the lower edge of the fascia for enclosing the fascia. The sheet member has a convex curved surface overhanging and extending from the fascia a distance greater than the second portion such that water run off will follow the sheet member into the mouth of the trough formed by the second portion and debris will fall via gravity beyond the trough.

Figure 1:
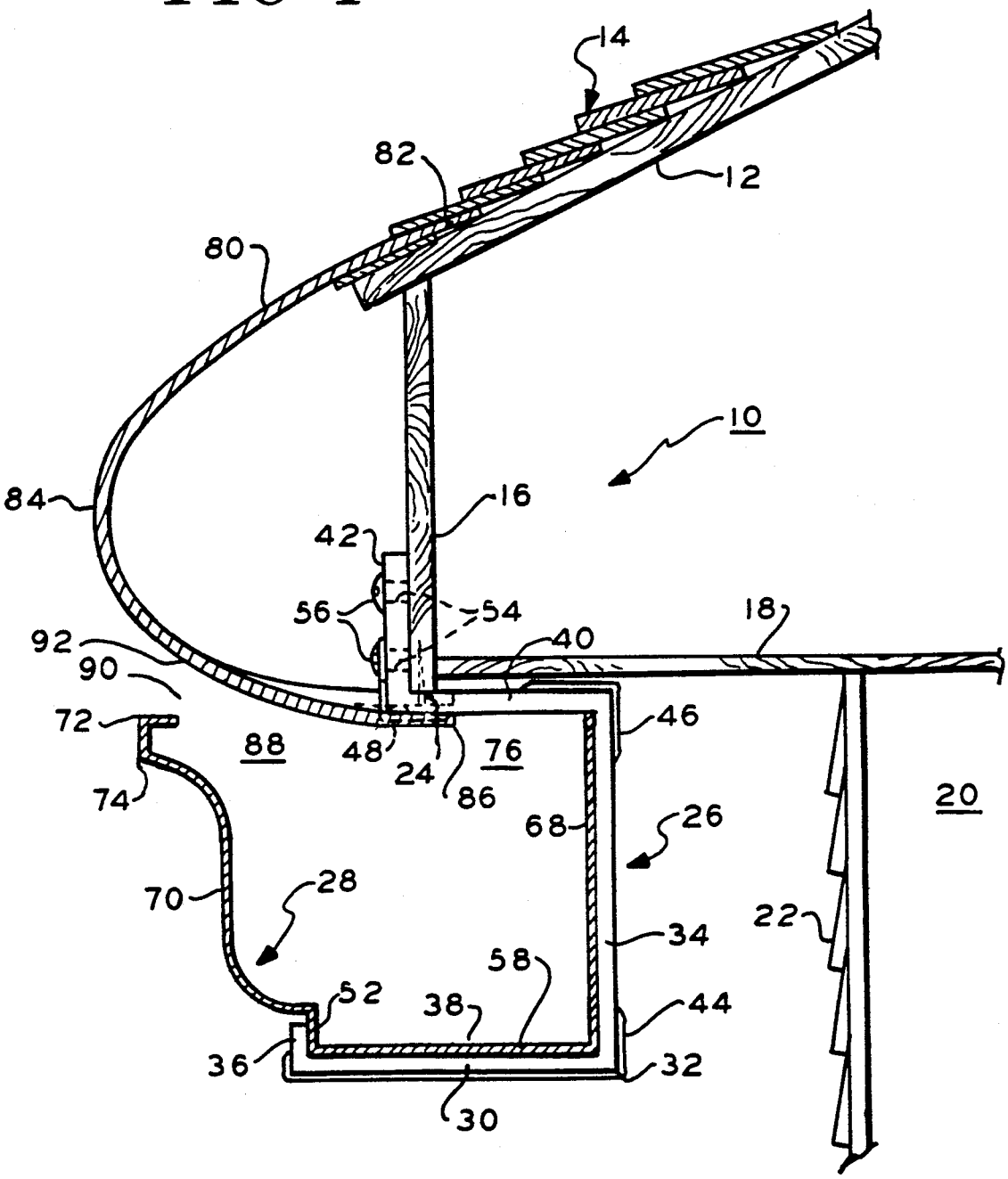
FIG. 1 is a sectional elevation view of a gutter and support bracket according to one embodiment of the invention.

In FIG. 1, a building 10 includes a roof deck 12 supported on rafters (not shown), the deck typically being fabricated out of plywood or similar materials. Over the deck are secured waterproofing sheet material (not shown) and a layer of overlapping shingles 14. A fascia board 16 is secured to the end of the rafters beneath the deck 12. The board 16 is normally vertical with respect to gravity. The deck 12 is typically pitched at some angle to the horizontal. A soffit 18 is secured to the underside of the rafters and extends horizontally toward the building interior 20. The building has an exterior vertical wall 22. Fascia board 16 typically has a lower edge 24 which depends below the soffit 18.

Figure 3:
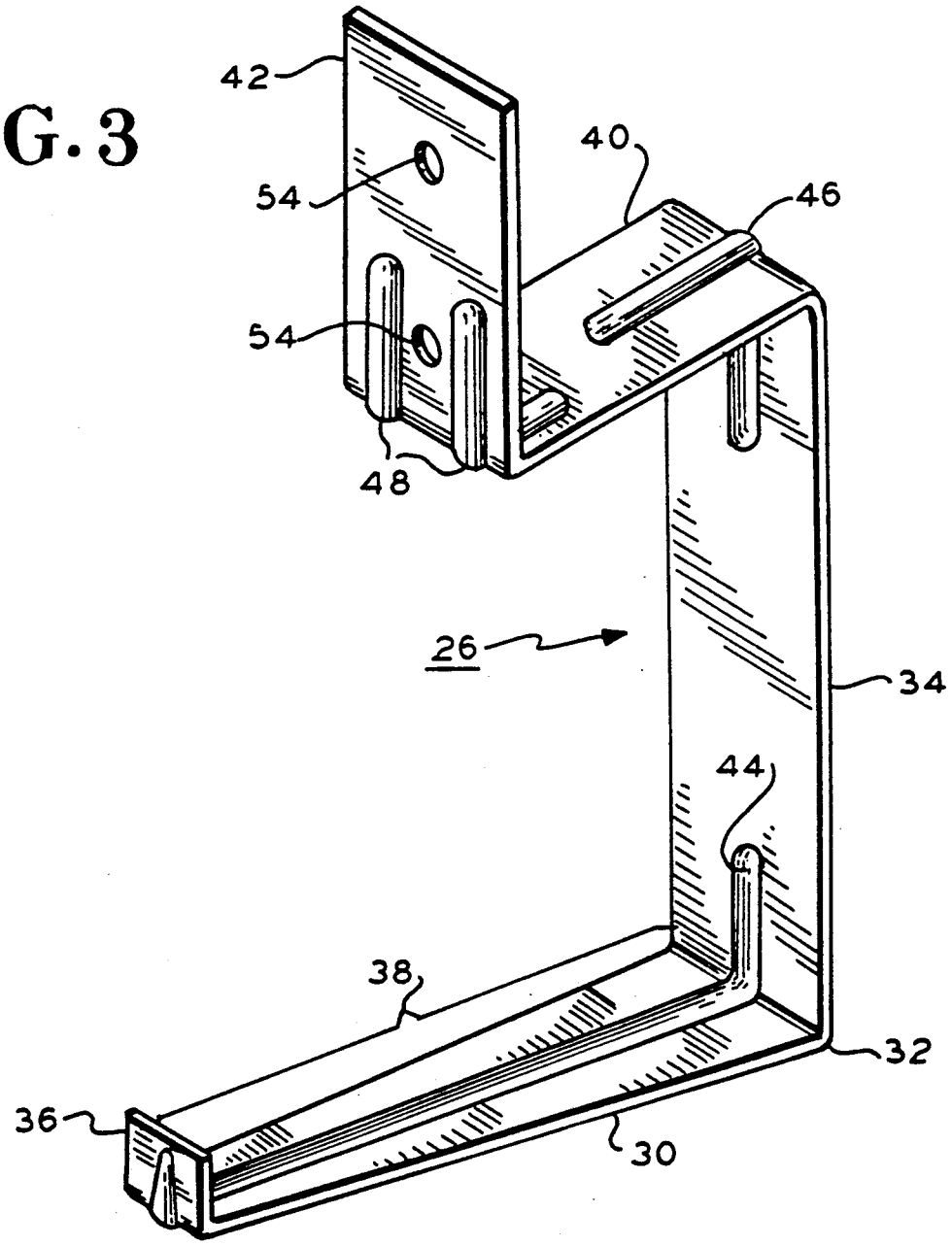
FIG. 3 is an isometric view of the bracket of FIG. 1.

Bracket 26 secures a K type gutter 28 to building 10. In FIGS. 1 and 3, bracket 26 includes a leg 30 extending from junction 32 with leg 34, the legs being normal to each other. A lip 36 upstands from the extended end of leg 30. The lip 36 is preferably parallel to leg 34 and defines a channel region 38 therebetween. A leg 40 extends from the extended end of leg 34. An upstanding flange 42 extends from the extended end of leg 40. Leg 34, flange 42 and lip 36 are preferably parallel. Leg 40 is preferably parallel to leg 30. The bracket 26 may be formed from sheet aluminum of about 0.70 to 0.100 inches thick. Legs 30, 34, 40 and 42 may be about one inch wide A reinforcing rib 44 is formed in legs 30 and 34 including junction 32. A reinforcing rib 46 is formed in legs 34 and 40 including the junction therebetween, the rib extending into lip 36. Two parallel reinforcing ribs 48 are formed in leg 40 and flange 42 and in the junction between the leg and flange. The ribs have a depth sufficient to reinforce the bracket for supporting ice and water loads. Flange 42 has two spaced apertures 54 for receiving screws 56.

The typical K gutter 28, FIG. 1, includes a flat bottom wall 58. A vertical rear side wall 60 upstands from the rear edge of bottom wall 58. In practice, the typical K gutter rear wall also may have an outwardly bent upper lip (not shown). The bent lip upper edge abuts the upper inner corner of the bracket at the junction of legs 34 and 40 spacing wall 68 slightly from leg 34. A lip 52 upstands from the front edge of bottom wall 58. A reverse somewhat S-shaped front wall 70 extends upwardly from lip 52 and forward of lip 52 forming an outwardly flared channel with rear wall 68. An L-shaped lip 72 extends from the upper edge 74 of front side wall 70. The outer width dimension of rear wall 68 to lip 52, for example 3 5/16 inches, is slightly less than the width of channel region 38 between bracket lip 36 and leg 34. This spacing permits the gutter 28 to be readily assembled to and from the bracket 26. By way of example, in the gutter 28, lip 52 is about ½ inch in height. Wall 58 is about 3¼ inches wide and wall 68 is about 3¾ inches in height. In the bracket 26, lip 36 is about ½ inch in height, leg 30 is about 3⅜ inches long, leg 34 is about 3¾ inches in height between legs 30 and 40, leg 40 is about 2½ inches long and flange 42 is about 3½ inches in height.

The gutter 28 and bracket 26 are so dimensioned such that the gutter fits snugly in the bracket between the bracket legs. Lip 52 and wall 68 of the gutter are so spaced apart such that they are closely received between the bracket lip 36 and leg 34. Further, the height of the lip 36 and the spacing between the bracket legs 30 and 40 is such relative to the height of gutter wall 68, the gutter is somewhat locked in place and is not easily dislodged, for example by wind or by the weight of water or ice in the gutter. If the gutter were to be lifted vertically toward leg 40, wall 58 does not clear lip 36 of the bracket precluding removal of the gutter in this direction.

Figure 2:
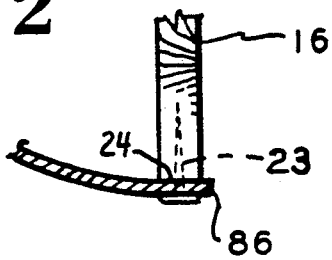
FIG. 2 is a sectional elevation view similar to the view of FIG. 1 showing the attachment of the sheet material to the fascia.

To install the gutter to the bracket requires the gutter to be rotated clockwise from the orientation of FIG. 2. In so tilting the gutter, the upper edge of wall 68 is placed in the underside corner between legs 34 and 40. This edge forms a pivot axis bearing against the inner corner of the bracket legs 34 and 40. The gutter is then rotated counterclockwise flexing wall 68 toward wall 70 slightly until gutter lip 52 clears bracket lip 36 and can be inserted adjacent to lip 36 in region 38 so wall 58 rests on wall 30 of the bracket.

With the gutter installed in the bracket, any force on the gutter in the counterclockwise direction, i.e., to the left in the Figure, tends to rotate the gutter about an axis parallel to the longitudinal axis of the gutter, normal to the drawing plane, and located at lips 36 and 52. Such a force, for example, is one induced by a water or ice load in the gutter. However, the gutter can not rotate in this counterclockwise direction because the diagonal angle and distance from lip 52 to the upper edge of wall 68 at leg 40 is such that this edge of wall 68 needs to displace upward toward leg 40 when rotated counterclockwise. Leg 40 prevents such upward displacement of leg 68, locking the gutter in place. No amount of force in this direction can dislodge the gutter from the bracket.

However, to remove the gutter simply requires the manual rotation of the gutter from the orientation of FIG. 2 in a clockwise direction. This lifts lip 52 out of the channel formed by bracket lip 36. This requires a minimal flexing of the gutter wall 68 toward wall 70. Once lip 52 clears lip 36, the entire gutter is easily lifted from the bracket in the space between the upper edge of lip 36 and leg 40. Thus, to remove the gutter from the bracket, the reverse procedure from installation is used.

Other means, in addition, if desired, could be used to lock the gutter in place such as a bendable tab or the like attached to leg 34 or leg 40. Such a tab is formed from either leg and is sufficiently flexible so as to be manually bent over the edge of wall 68 of the gutter.

In one implementation, a plurality of brackets 28 are spaced along the fascia board 16 with the flange screwed to the front face of the fascia board 16 via apertures 54 and screws 56. The inner bracket corner at the junction of flange 42 and the leg 40 abuts the lower outer corner of the fascia board 16. The flange 42 is flush against the outside face of the fascia board 16 to rigidly secure the bracket in place when screwed to the board. Leg 40 overhangs leg 30, the leg 40 being shorter than leg 30. This permits the gutter mouth region portion 76 to be covered by the overhead soffit board 18. The brackets may be spaced in five to six foot intervals as compared to two foot intervals for prior art spikes. The soffit typically may be spaced somewhat above the bracket leg 40. In some implementations, it should be understood that some roof constructions may not have a soffit board, the rafters being exposed to the ambient below the roof deck. The bracket 28 in this case, being secured to the fascia board, need not be concerned with the presence of a soffit board. Therefore, in the claims the term "soffit" is meant to include structure without a soffit board such as exposed rafters or the like which are positioned at the location of a typical soffit.

In a further implementation, in some constructions a fascia board may not be employed. Here the ends of the rafters may be exposed. In this embodiment, the bracket 26 may be configured slightly different in that the leg 40 may be secured to the underside of a rafter or the flange 42 is rotated 90 degrees from the orientation shown for fastening to the side of a rafter. In the claims the term "fascia" is intended to include the equivalent fascia face of a rafter without a fascia board in place.

A sheet material layer 80, for example thermoplastic or metal, has one edge 82 secured to the deck under the shingles 14 above the fascia board 16. This sheet edge may be nailed, for example. The sheet is bent into a curve having an apex 84. A lower edge 86 of the layer 80 is nailed to the lower edge of the fascia board 16 by nails 23, FIG. 2. The layer edge 86 is formed over the legs 40 of the different brackets along the roof edge. The apex 84 extends a distance from the fascia board 16 greater than the mouth portion 88 of the gutter 28. Thus, the apex 84 juts out beyond the gutter in a direction away from the fascia board. The gutter lip 72 forms a trough mouth 90 with the adjacent facing surface 92 of the layer 80. Thus the layer 80 is separate from and spaced from the gutter 28. Mouth 90 is substantially smaller in width than the width of the mouth of gutter 28 comprising portions 76 and 88. However, leg 68 is at a horizontal level approximately the same as that of the lower edge 86 of the layer 80. This smaller mouth width acts as a debris guard tending to block larger debris elements such as branches and large leaves. In those cases where there may be no fascia board, layer 80 may be secured at its lower edge directly to the exposed rafters. In FIG. 1, edge 86 may also be bent over the bracket legs 40 at the lower edge of flange 42.

The smooth curved surface of layer 80 tends to carry water run off from the shingles 14 around to its underside into mouth 90 of the gutter 28. The inertia of the water may impinge it against the rear gutter wall 68 or due to its weight, drop into the gutter channel. The fact that the gutter wall 68 is at about the same level as the layer edge 86 insures that the flowing water does not flow beyond the gutter to any significant extent. Meanwhile, heavier debris tends to fall from the apex region via the force of gravity. Smaller particles of debris which might be carried into the gutter would also be carried off to the downspout (not shown) and drained from the gutter.

The bracket 28 serves the unique function of permitting a standard K gutter to be used in a way to preclude debris build up and ice damming. As long as water can properly drain from the gutter, water overflow is precluded. Also, by placing the gutter beneath the fascia board and soffit, damage due to ice damming is also precluded since water overflowing the gutter due to ice build up merely drains harmlessly to the ground away from the shingled area over the edges of gutter lip 72 and wall 68. Such water may overflow the front or rear side walls of the gutter since the brackets present negligible interference with such overflow over the rear side wall and due to the spacing of gutter wall 68 upper edge from the overhead soffit board 18. It is important that water over flow the gutter, because otherwise the weight of the additional ice may cause the bracket 26 to otherwise bend. To preclude such bending, the bracket thickness and material strength are combined with ribs 44 and 46 which are dimensioned to withstand such possible ice loads. However, the amount of ice build up is limited due to the openness of the gutter at the upper edges of the front and rear walls. In prior art systems, the gutter is typically next to the shingle area which permits larger ice loads to build up than that occurring with the system of the present invention.

Because the lip 36 of the bracket is relatively short in height, it is a simple matter to install or replace the K type gutter without removing the brackets. Thus, by merely installing the brackets at the desired spacing, the extruded gutter of a given length can be installed relatively quickly and easily without tools. In this respect, the brackets and gutters are much more easily replaced than the prior art spikes which occassionally work loose or, due to barbs on the spike ends, are difficult to replace.

In the alternative, the gutter may be entirely underneath the soffit region rather than partially as shown depending upon a given implementation. Also, the gutter may be forward of the position shown, that is to the left of the FIG. 1 position so as to not be underneath the soffit at all. The important aspect is that the gutter is spaced significantly below the roof surface to preclude ice damming over the shingled area. Of course, the sheet member apex in the latter case would also extend further to the left in the drawing.

As an alternative to flange 42, apertures may be placed in legs 34 or 40 to secure the bracket to the building in certain implementations.

What is claimed is:

1. A gutter and bracket assembly for receiving water from a building roof comprising:

an elongated channel member forming a rain gutter having a bottom wall and two spaced upstanding side walls normal to the bottom wall defining an open water receiving channel, said side walls having upper edges defining a mouth between the side walls; and a channel member support bracket comprising first and second legs extending in a direction generally normal to each other from a junction therebetween, a lip extending upstanding from an end of the first leg distal said junction juxtaposed with and spaced from the second leg, a third leg extending from an end of the second leg distal said junction and juxtaposed over and spaced from the first leg, said lip having a length shorter than that of the second leg for receiving the channel member in the region between said lip and third leg, the dimensions of the channel member and the first, second, third legs and lip are such so as to releaseably secure the channel member to the bracket to preclude rotational release in a given direction.

2. The assembly of claim 1 further including bracket support means coupled to one of said legs for securing the bracket to the building so that the channel member receives said water from said roof.

3. The assembly of claim 1 wherein the channel member has a longitudinal axis along the channel, said legs and member are so dimensioned such that one of said side walls is closely received between said first and third legs and such that rotation of the channel member is precluded in a first rotation direction about an axis parallel to said longitudinal axis at a bearing formed by the junction of the bottom wall and the other side wall and the junction of the lip and first leg.

4. The assembly of claim 3 wherein one of said member side wall abuts said lip and the other of said side walls is adjacent to the second leg, said lip extending an amount sufficient to form with said third leg a channel member receiving opening therebetween for rotatably receiving the channel member only when the channel member is rotated in a direction opposite said first rotation direction.

5. The assembly of claim 1 wherein the building includes a fascia and soffit adjacent to the roof, said channel and bracket being so dimensioned such that when secured to the building, the channel member mouth is beneath the fascia, said assembly further including a curved sheet member having one edge region adapted to be secured to the roof and a second edge region adapted to be secured adjacent to the fascia distal the roof, said sheet member when secured in place having a convex curved surface overhanging said mouth.

6. The assembly of claim 5 wherein the apex of the curved sheet member when secured to the building is spaced from the fascia a distance in a given direction greater than the channel member in that direction so as to extend beyond the mouth in that direction.

7. The assembly of claim 6 wherein the sheet member second edge region is spaced from the channel member over the channel mouth.

8. The assembly of claim 7 wherein one of the channel side walls abuts the lip and a second side wall is adjacent to the second leg, the one wall having a lip portion abutting said lip, an approximate reverse S-shaped portion extending from the lip portion and an L-shaped lip portion extending from the S-shaped portion, said L-shaped portion being positioned beneath said sheet member when the assembly is secured to said building.

9. The assembly of claim 2 wherein said bracket support means comprises a support flange upstanding from an end of the third leg distal said second leg.

10. The assembly of claim 1 wherein the building includes a soffit and fascia, said legs being oriented such that said third leg extends juxtaposed with said soffit, the lip being dimensioned and spaced from the second leg a distance to receive said channel member therebetween so that the first leg supports said member bottom wall and the third leg extends over at least one of said side walls.

11. A gutter assembly for a building having a fascia and soffit wherein the fascia depends beneath the building roof adjacent to the soffit, said assembly comprising:

an elongated channel member forming a rain gutter having a bottom wall and two spaced upstanding side walls defining an open water receiving channel;

at least one channel member support bracket comprising first and second legs extending in a direction generally normal to each other from a junction therebetween, a lip extending upstanding from an end of the first leg distal said junction juxtaposed with and spaced from the second leg, a third leg extending from an end of the second leg distal said junction and juxtaposed with and spaced from the first leg, a bracket support flange extending from the third leg distal the junction of the third leg with the second leg, said flange being dimensioned and adapted to be secured to said building such that said third leg is juxtaposed with said soffit, the lip being dimensioned and spaced from the second leg a distance to receive said channel member therebetween so that the first leg supports said member bottom wall and the third leg extends over a portion of the channel, said channel and bracket being so dimensioned such that when secured to the building, the channel member has a first channel mouth portion beneath the fascia and soffit and a second channel mouth portion extending beyond the fascia and soffit; and a bent sheet member adapted to be secured to the building spaced from and separate from the channel member and having one edge region adapted to be secured to the roof and a second opposing edge region adapted to be secured at the fascia region distal the roof, said sheet member when secured to the building having a convex curved surface covering the fascia and extending from the fascia a distance greater than said second portion, the sheet member being so positioned for receiving and guiding water run off from the roof into the gutter and for causing debris to fall by gravity outside the gutter.

12. The assembly of claim 11 which when secured to said building is arranged such that the sheet member is spaced over the mouth of the channel member forming an opening to said mouth substantially smaller than the width of said mouth between said side walls.

13. A rain gutter channel member support bracket for securing the channel to said building, said bracket comprising:

first and second legs having a length extending in a direction generally normal to each other from a junction therebetween;

a lip extending upstanding from an end of the first leg distal said junction juxtaposed with and spaced from the second leg;

a third leg having a length extending from an end of the second leg distal said junction and juxtaposed over and spaced from the first leg; and a bracket support flange extending in a direction away from the first leg and upstanding from an end of the third leg distal the junction of the third leg with the second leg, said support flange being dimensioned and adapted to be secured to said building such that said third leg extends juxtaposed with and beneath said soffit, the lip being dimensioned and spaced from the second and third legs to receive said channel member therebetween so that the first leg supports said member and the third leg extends over at least a portion of the channel mouth such that the lip and legs releaseably secure the channel member to the bracket to preclude rotational release in a given direction.

14. The bracket of claim 13 wherein the lip is less than one fourth the length of the second leg.

15. The bracket of claim 13 wherein the third leg and lip are so spaced and dimensioned relative to said channel member such that the member can be attached to and released from the bracket only when rotated in first corresponding respective opposing directions.

16. The bracket of claim 13 including rib means in said lip, legs and flange.

17. A rain gutter channel member support bracket for securing the channel member to the building, said channel member having a bottom wall and two spaced upstanding side walls, said bracket comprising:

first and second legs having a length extending in a direction generally normal to each other from a junction therebetween;

a lip extending upstanding from an end of the first leg distal said junction juxtaposed with and spaced from the second leg a distance for receiving the channel member therebetween with one side wall abutting the lip and the other side wall adjacent to the second leg;

a third leg extending from the second leg cooperating with said lip and first and second legs to rotatably releaseably secure the channel member to said lip and legs and to preclude rotational release in a given direction; and bracket support means coupled to one of said legs for securing the bracket to the building.

18. The bracket of claim 17 wherein said support means comprises a bracket support flange extending in a direction away from the first leg and upstanding from an end of the third leg distal the junction of the third leg with the second leg.

19. A bracket for securing a gutter to a building, said gutter comprising an elongated channel member having a bottom wall and two spaced upstanding side walls defining an open water receiving channel, said side walls having upper edges defining a mouth between the side walls, said bracket comprising:

first and second legs extending in a direction generally normal to each other from a junction therebetween;

a lip extending upstanding from an end of the first leg distal said junction juxtaposed with and spaced from the second leg; and a third leg extending from an end of the second leg distal said junction and juxtaposed with and spaced from the first leg, said second leg having a length about the same as the height of one of said side walls such that said one side wall is closely received between said first and third legs, said lip having a length shorter than that of the second leg for rotatably receiving the channel member in the region between said lip and third leg, the dimensions of the channel member and the first, second, third legs and lip are such so as to release the channel member from the bracket when the channel member is rotated in one direction and lock the channel member to the bracket when the channel member is rotated in the opposite direction.

* * * * *